US006416223B2

(12) United States Patent
de Laforcade

(10) Patent No.: US 6,416,223 B2
(45) Date of Patent: Jul. 9, 2002

(54) CONTAINER AND METHOD OF MANUFACTURING A CONTAINER

(75) Inventor: Vincent de Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/760,829

(22) Filed: Jan. 17, 2001

Related U.S. Application Data

(62) Division of application No. 09/461,404, filed on Dec. 15, 1999, now Pat. No. 6,267,507.

(30) Foreign Application Priority Data

Dec. 16, 1998 (FR) ..... 98 15896

(51) Int. Cl.[7] ..... B65B 43/08
(52) U.S. Cl. ..... 383/456; 53/452
(58) Field of Search ..... 53/450, 410, 456, 53/452, 453, 461, 463, 473; 493/264, 267, 376, 397, 404

(56) References Cited

U.S. PATENT DOCUMENTS

| | | | | | |
|---|---|---|---|---|---|
| 490,680 | A | | 1/1893 | Roberts | |
| 1,240,564 | A | | 9/1917 | Harrington | |
| 2,270,236 | A | | 1/1942 | Blakemore | |
| 2,935,238 | A | | 5/1960 | Koehler | |
| 3,063,614 | A | | 11/1962 | Orsini | |
| 3,144,129 | A | * | 8/1964 | Weisberg | 206/45.24 |
| 3,577,699 | A | * | 5/1971 | Silver | 53/175 |
| 3,799,914 | A | | 3/1974 | Schmit et al. | |
| 3,834,113 | A | * | 9/1974 | Howe et al. | 53/14 |
| 4,301,639 | A | * | 11/1981 | Hamilton | 53/456 |
| 4,539,236 | A | * | 9/1985 | Vilutis | 428/35 |
| 4,644,732 | A | * | 2/1987 | Morton | 53/412 |
| 4,667,453 | A | * | 5/1987 | Goglio | 53/415 |
| 4,881,825 | A | * | 11/1989 | Oleson | 383/906 |
| 5,016,755 | A | | 5/1991 | Kim | |

FOREIGN PATENT DOCUMENTS

| | | |
|---|---|---|
| GB | 0 588 343 | 5/1947 |
| GB | 1 397 485 | 6/1975 |

OTHER PUBLICATIONS

Patent Abstracts of Japan, vol. 097, No. 004, Mar. 12, 1996 (JP 08 318971).

* cited by examiner

*Primary Examiner*—Scott A. Smith
*Assistant Examiner*—Nathaniel Chukwurah
(74) *Attorney, Agent, or Firm*—Finnegan, Henderson, Farabow, Garrett & Dunner, L.L.P.

(57) ABSTRACT

A container for containing a product includes a base including three sides and three faces extending from the base. The faces form an apex opposite to the base and each face has three sides. One of the sides of each face is adjacent to a respective one of the sides of the base and the other two sides of each face are adjacent to a respective one of the sides of another face. The container further includes first, second, and third sealed seams. The first sealed seam includes adjacent sides of two of the faces. The second and third sealed seams each include one of the sides of the base and the corresponding adjacent side of one of the faces.

14 Claims, 2 Drawing Sheets

CONTAINER AND METHOD OF MANUFACTURING A CONTAINER

This is a divisional of application Ser. No. 09/461,404, filed Dec. 15, 1999 now U.S. Pat. No. 6,267,507, the entire disclosure of which is incorporated herein by reference.

The present invention relates to a container obtained by folding a sheet formed from a single-layer structure or from a multi-layer structure. Preferably, the sheet is flexible and made from paper, plastic, and/or metal.

Containers of this type are widely used in the fields of foodstuffs, cosmetics, pharmacy, and dermatology industry. Such containers are particularly advantageous because they are economical and allow the packaging of one metered amount of a given product.

Generally, prior containers formed from folding a sheet have a flat structure that is obtained by folding the sheet on itself, welding the folded sheet over three of its edges, and then filling the container via an opening defined by the fourth edge. After filling, the opening formed by the fourth edge is closed in the same manner as the other three edges.

These folded-sheet containers, however, suffer from the drawback that they hold a relatively small volume of product compared to their surface area. To store larger volumes, the container must have a large surface area, which may cause the container to be bulky and difficult to empty. Moreover, as explained in detail below, after opening such containers, it is virtually impossible to keep the container "upright" on a flat surface so as to prevent its contents from spreading over the surface that supports it. Of course, it is possible to lean the container against an upright vertical supporting surface, but such surfaces are not always present and even if they are present, the container could be knocked over from its leaning arrangement causing spilling of the contents.

In the field of hair dyeing, there is a range of products known as "direct-dye" products, application of which does not require the addition of an oxidizing agent. These dyes are often in liquid form and are deposited directly onto the hair to be dyed. Such products are generally packaged in small bottles which, for reasons of compatibility with the formula, are usually produced from polyvinyl chloride (PVC). For aesthetic, economical, and practical reasons, it is desirable to package such products in containers different from the small PVC bottles that are currently used. In particular, it is preferably to package direct-dye products in packaging that is economical to produce and that facilitates a novel and attractive method of application.

Flat containers of the type described above are beginning to be used for packaging such dye products. The application of dye products onto the head, however, requires progressive distribution of the liquid by two-handed massaging so that the entire head of hair absorbs all the liquid. Because the application process requires both hands, the user must be able to put down the container before all of the dye has been dispensed from the container. Unfortunately, flat containers pose a major problem for dye products application because once opened (e.g., by cutting or tearing an easy-open section), the containers cannot be set down on a work surface without being placed against a vertical object or surface. If the flat container is not kept upright, the contents may disadvantageously leak from the container.

In an effort to overcome the above-mentioned problems with flat containers, one may try to use TETRAPACK®-type containers. To use these devices, it would be necessary to reinforce the walls with cardboard to enable formation of folds in the container. The use of stiff cardboard to make folds in TETRAPACK®-type containers, however, results in acute angles, which tend to generate leaking problems in the containers.

Patent Abstracts of Japan No. 08318971 describes a container formed from an open cylinder welded at its two open ends by means of two weld lines that are perpendicular to each other. The container has the form of a "carton," which cannot be placed "upright" on a flat surface. Moreover, when the disclosed container is positioned on its side, it occupies a very large surface area. A further drawback is that the base has a large surface area compared with the height, which gives rise to the presence of air above the free surface of the product, thereby creating a deleterious effect on product quality.

U.S. Pat. No. 2,270,236 describes a container having four faces welded along three edges. The disclosed container is obtained by folding a rectangular sheet having two small sides and two large sides. A major drawback of the container described in this reference is that the edges are configured so that when the container rests on its base, the two welded edges which define the base and form feet of the container extend substantially perpendicular to the base. Moreover, the container includes reinforcing means on the welded edges to maintain the feet substantially perpendicular to the plane of the base.

In light of the foregoing, there is a need in the art for an improved container obtained from folding a sheet of material.

Accordingly, the present invention is directed to a container and a method of manufacturing a container that obviate one or more of the short-comings of the related art.

A preferred object of the invention is to provide a container obtained from a sheet of material, which is capable of standing "upright" on a flat surface.

Another preferred object of the invention to provide a container that makes it possible to limit the volume of air present above the free surface of the product inside the container.

A further preferred object of the invention to provide a container made from a flexible sheet that for a given surface area of the sheet, holds a volume of product that is substantially greater than the volume that can be packaged in a conventional folded-sheet container.

Yet another preferred object of the invention is to provide a container manufactured from a sheet of material, wherein the sheet is configured to reduce the amount of material that must be trimmed from the container during manufacturing.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a container for containing a product. The container includes a base including three sides and three faces extending from said base. The faces form an apex opposite to said base and each face has three sides. One of the sides of each face is adjacent to a respective one of the sides of the base and the other two sides of each face are adjacent to a respective one of the sides of another face. The container further includes first, second, and third sealed seams. The first sealed seam includes adjacent sides of two of the faces. The second and third sealed seams each include one of the sides of the base and the corresponding adjacent side of one of the faces. Preferably, the first sealed seam extends from the base to the apex. The container is preferably formed of a substantially square sheet of material and has a substantially triangular transverse cross-section decreasing from said base to said apex.

The transverse cross-section of the container is the cross-section parallel to a plane including the base. Preferably, the container of the present invention may be manufactured with a limited number of simple folding operations. Moreover, the container may be placed on a flat surface without risk of the product leaking from the container. Additionally, the decreasing cross-section of the container from the base to the apex makes it possible to use the apex as an outlet orifice by removing an end portion of the container to form a tip for direct application of the product to a surface to be treated.

In another embodiment, the second and third sealed seams are configured to extend in a plane including the base when then container is placed on the base.

In still another embodiment, the sides included in the first sealed seam do not overlap one another.

Preferably, the first sealed seam is longer than the length of each of the second and third sealed seams. The second and third sealed seams are preferably the same length. More preferably, the length of the first sealed seam is approximately twice the length of the second and third sealed seams. The cross section of the base is preferably small compared to the height of the container, making it possible to produce a container tapered from the base to the apex. This tapered configuration facilitates reduction of the volume of air above the free surface of the product inside the container.

As explained above, the container is preferably produced with a square sheet of material. Production of the container using a sheet with four equal sides facilitates the folding operations and reduces and/or eliminates the need to trim material from the container after the folding of the material. The sheet is preferably flexible.

To form the container, a sheet is folded about a diagonal and then folded about an axis perpendicular to the diagonal.

Preferably, the three sealed seams are substantially perpendicular to one another and intersect near the base of the container. In one embodiment, the second and third sealed seams extend in the plane of the base when the container is supported by the base. This feature allows the container to be placed on its base in an extremely stable manner.

In a preferred embodiment, the three faces include first, second, and third faces, wherein the second sealed seam includes one of the sides of the second face, and the third sealed seam includes one of the sides of the third face. The first and second sealed seams are preferably configured to extend in a plane including the second face when the container is supported by the second face, and the first and third sealed seams are preferably configured to extend in a plane including the third face when the container is supported by the third face. This configuration allows the container to be placed in a stable manner on any of its three faces and/or its base. Furthermore, this feature facilitates making the container free from leaks, particularly at the point where the three sealed seams intersect. Indeed, the container of the present invention preferably has a seal at least equivalent to the flat, folded-sheet containers.

The sheet preferably includes at least one layer of a material chosen from paper, plastic, metal, and/or a combination of materials thereof. Preferably, the sheet includes a combination of materials including at least one layer of aluminium. The portion of the sheet on the outside of the container preferably includes a material capable of receiving printing and/or decorations. For example, the material on the outside surface of the container may be a layer of paper.

The seams of the container are preferably closed by any appropriate method, such as adhesive bonding and/or welding. Preferably the closing of the seams includes the use of heat and/or ultrasound.

Preferably, the container includes an orifice proximal to the apex of the container for dispensing product from the container. The orifice is preferably a tip formed by at least of tearing and cutting the container. Preferably, the container includes at least one zone of weakness on the container (e.g., score line, perforation, pre-formed tear, and/or initial cut-out) to facilitate tearing and/or cutting of the container to produce the orifice.

In another aspect, the invention includes the container described above with a product packaged therein. Preferably, the product is a cosmetic product, such as a hair-dye product. A product of this type may be in liquid or solid form. Preferably, the product is a powder.

In a further aspect, the invention includes a method of manufacturing a container. The method includes providing a substantially square sheet of material, wherein the sheet has first and second pairs of adjacent sides. The sheet is folded about a diagonal of the sheet. At least portions of the first pair of sides are joined together to form at least a portion of a first seam of the container. A first end of the diagonal is adjacent to the first seam. The sheet is then folded about an axis substantially perpendicular to the diagonal to position a second end of the diagonal adjacent to an end of the first seam opposite to the first end of the diagonal. Thereafter, portions of one of the second sides are joined together to form a second seam of the container and portions of the other of the second sides are joined together to form a third seam of the container. Preferably, the resulting container includes a base defined by the second and third seams and an apex, wherein the apex is substantially opposite to the base and adjacent to the first end of the diagonal.

The joining preferably includes sealing respective portions of the sheet. Preferably, the sealing includes at least one of adhesive bonding and welding. More preferably the sealing includes the use of at least one of heat (i.e., thermal welding) and ultrasound (i.e., ultrasonic welding).

Preferably, the folding of the sheet about the axis substantially perpendicular to the diagonal includes moving portions of the one of the second sides toward one another and moving portions of said other of the second sides toward one another.

In one embodiment, the method further comprises inserting a product into the container via an opening defined by the second pair of sides after folding the sheet about the diagonal.

In another embodiment, a product is inserted into the container via an opening defined by the first pair of sides. The product is preferably introduced into the container after at least substantial formation of one of the second and third seams and prior to substantial formation of the other of the second and third seams.

The container produced by the method preferably has a triangular cross-section that decreases from the base of the container towards its apex. The container is sealed along the first, second, and third seams. The first seam preferably extends from the base to the apex, and the second and third seams extend in the plane of the base of the container when the container is supported by the base. The length of the first seam is preferably equal to twice the length of each of the second and third seams.

The first and second seams preferably define a second face and the first and third seams define a third face. In a preferred embodiment, the first and second seams extend in a plane including the second face when the container is supported by the second face, and the first and third seams extend in a plane including the third face when the container is supported by the third face.

In one embodiment, the method further comprises folding the sheet to facilitate the folding of the sheet about an axis substantially perpendicular to the diagonal.

Preferably, the folding of the sheet about the diagonal forms an intermediate structure including first and second walls. In an embodiment, the method further comprises separating the first and second walls to form an opening. The product is preferably inserted through the opening. This step facilitates the folding of the second end of the diagonal. In an alternate embodiment, the walls of the intermediate structure are separated with an appropriate tool.

Besides the structural arrangements set forth above, the invention could include a number of other arrangements, such as those explained hereinafter. It is to be understood that both the foregoing general description and the following detailed description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1A is a front view of an embodiment of a container;

Reference will now be made in detail to the present preferred embodiments of the invention, examples of which are illustrated in the accompanying drawings. Wherever possible, the same reference numbers are used in the drawings and the description to refer to the same or like parts.

Figure 1A:
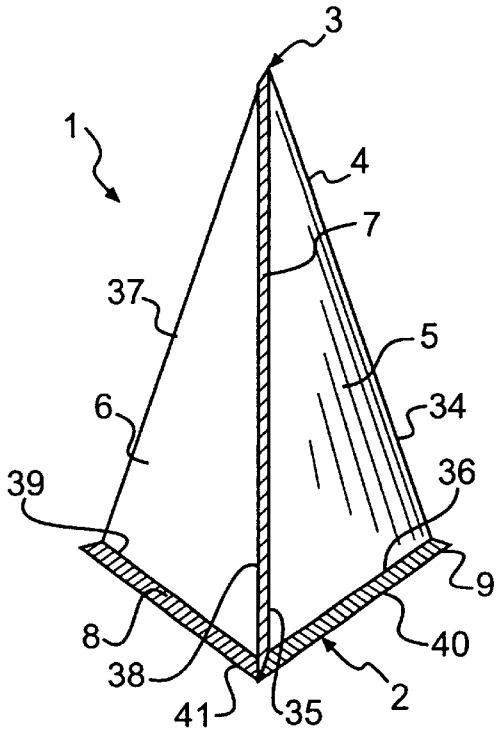
FIG. 1B is a side view of the embodiment of FIG. 1A.
FIG. 1C is a rear view of the embodiment of FIGS. 1A and 1B.
Figure 1B:
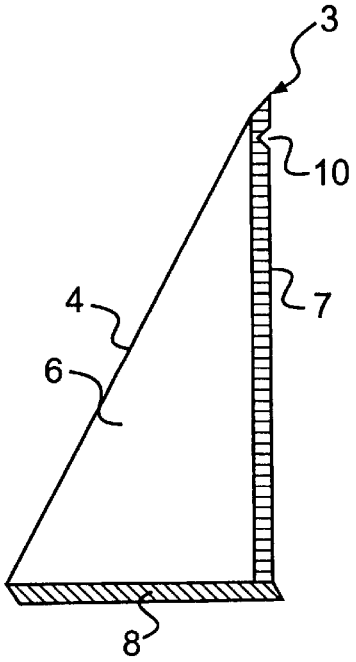
Figure 1C:
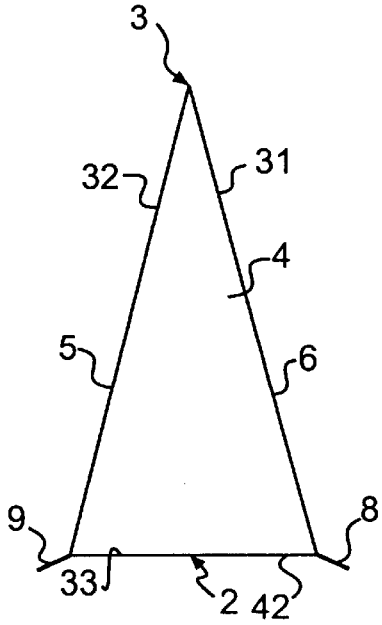

Referring to FIG. 1A–1C, a container 1 includes a base 2 and an apex 3. The container 1 is preferably an irregular tetrahedron. The base 2 includes sides,40, 41, 42. Between the base 2 and the apex 3 the container has a substantially triangular cross-section in a plane parallel to the base 2, which decreases from the base 2 to the apex 3. First, second and third triangular faces 4, 5 and 6 preferably extend from the base 2 to the apex 3. The faces 5 and 6 preferably are right-angled triangles. The first face 6 and the base 2 are preferably isosceles triangles. The first face 4 includes sides 31, 32, 33, the second face 5 includes sides 34, 35, 36, and the third face 6 includes sides 37, 38, 39. The container 1 includes three flexible, sealed seams 7, 8, and 9. The first sealed seam 7 includes sides 35, 38, and extends from the base 2 to the apex 3. The second sealed seam 8 includes sides 39, 41, and the third sealed seam 9 includes sides 36, 40. Preferable, the seams 8 and 9 have the same length and extend in the plane of the base 2 when the container is supported by the base 2. When the container 1 is supported by the face 6, the sealed seams 7 and 8 preferably extend in the plane of the face 6 and the sealed seam 9 is substantially perpendicular to the plane of the base 2. When the container 1 is supported on its face 5, the sealed edges 7 and 9 preferably extend in the plane of the face 5 and the sealed seam 8 is substantially perpendicular to the plane of the base 2.

Preferably, the container 1 is obtained by folding a rectangular sheet with four equal sides (i.e., a square sheet). Therefore, the length of the sealed seam 7 is twice the length of each of the sealed seams 8 and 9. The sealed seams 7, 8 and 9 are preferably sealed by heat welding and/or by adhesive bonding. Preferably, the container 1 includes a zone of weakness 10 near the apex 3, which facilitates tearing and/or cutting of the container 1. For example, the zone of weakness 10 is a notch in the sealed seam 7.

As shown in FIG. 1A, the two sides 40, 41 of the two sealed seams 8, 9 partially define the base 2 of the container 1. When the container 1 is supported by the base 2 on a flat surface, the container 1 stands in an upright position with the two sealed seams 8 and 9 extending in the plane of the base 2.

The sheet of material used to make the container 1 is preferably formed from a combination of materials, which includes at least one layer of a material that can be welded to itself. The sheet also preferably includes a layer of aluminium and an outer layer that may be printed with a decoration or with information relating to the contents of the container 1. The container 1 preferably contains a product for direct dyeing of the hair.

In order to use the contents of the container 1, the user tears or cuts the end of the container 1 at the notch 10 and applies the product to the head of hair. The apex 3 of the container 2 forms an applicator tip permitting the product to be applied in a localized manner. After application of a certain quantity of product, the user can stand the open container 1 on a work surface and massage the product into the head of hair with his hands. The user can then pick up the container 1 to complete application of the product from the container 1 onto the head of hair.

Figure 2A:
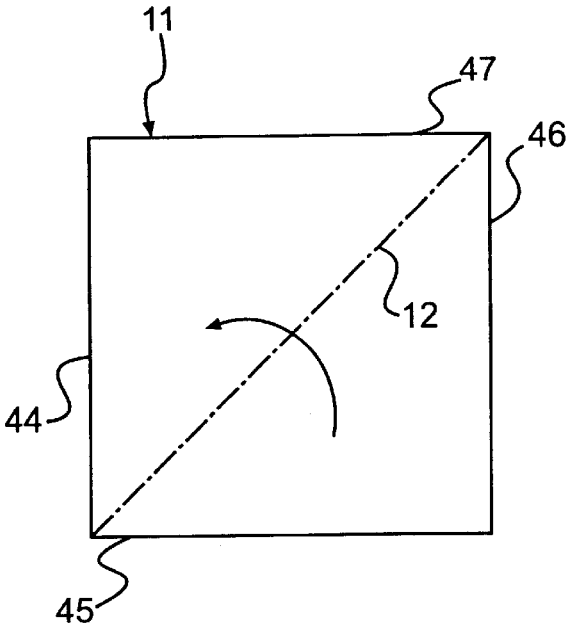
FIGS. 2A–2D illustrate several steps in a method of making the container of FIGS. 1A–1C.

FIGS. 2A–2D show a method of manufacturing a container like the container 1 described above. Referring to FIG. 2A, a square sheet 11 includes a first pair of adjacent sides 44, 45 and a second pair of adjacent sides 46, 47. The sheet 11 is folded about a diagonal 12 of the sheet 11. The diagonal 12 of the sheet 11 refers to a diagonal that extends from substantially one corner of the sheet 11 to substantially another, opposite corner of the sheet 11. For example, the diagonal 12 of the sheet 11 may extend from substantially the corner of the sheet 11 defined by sides 44 and 45 to substantially the corner of the sheet 11 defined by sides 46 and 47, as shown in FIG. 2A.

Figure 2B:
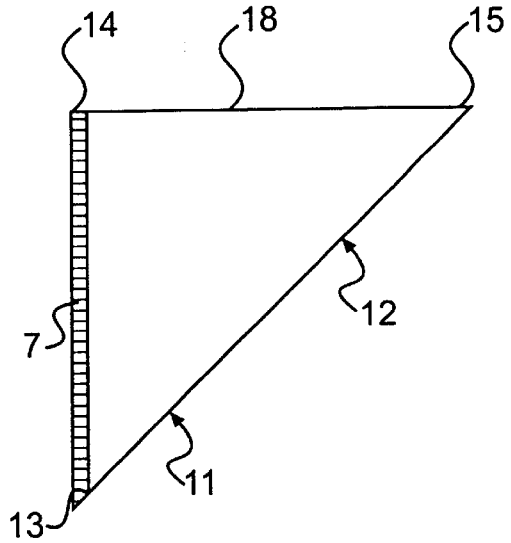

Referring to FIG. 2B, at least portions of the first pair of sides 44, 45 are joined together to form at least a portion of the first seam 7. Preferably, the seam 7 is welded under heated conditions over its entire height. The seam 7 preferably extends from a first end 13 of the diagonal 12 to an end 14 of the seam 7. The end 14 of the seam 7 is opposite to a second end 15 of the diagonal 12. The intermediate structure shown in FIG. 2C includes walls 16, 17, which can be separated between the ends 14 and 15 to form an opening 18. Preferably, the sheet 11 is pre-folded to create folds 19, 20 substantially in the center of each of the faces 16, 17. Next, the end 15 of the diagonal 12 is folded about an axis A substantially perpendicular to the diagonal 12 to position the second end 15 of the diagonal 12 adjacent to the end 14 of the first seam 7. The folds 19, 20 facilitate folding of the diagonal 12 about the axis A. The axis A preferably passes through the two folds 19, 20, and the axis A defines part of the base 2 of the container 1. Portions of the sides 46 and 47 are then joined to form second and third seams 8, 9, respectively, from the axis A to the end of 14 of the sealed seam 7.

Product is preferably introduced into the container 1 via an opening (not shown) formed by the seam 9 opposite the seam 8. The seam 9 is then sealed under heated conditions and/or adhesively bonded.

Alternatively, the container 1 can be filled with product during the process of manufacturing the container 1 by sealing two of the three seams 7, 8, 9 and partially sealing the third seam. During filling, the non-sealed seam may be opened to allow filling, for example, by means of a separator with suction cups. The remainder of the seam is then sealed.

Figure 2C:
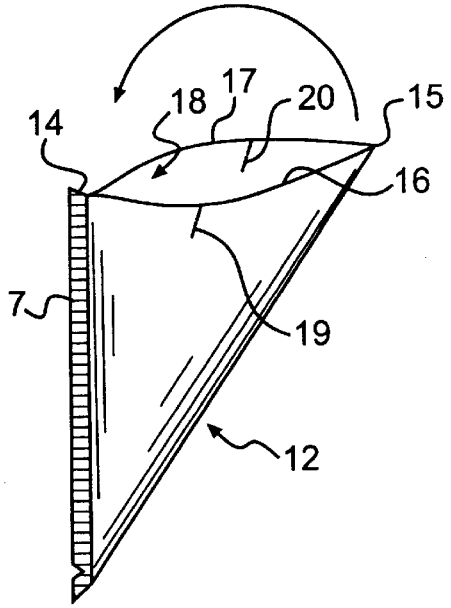

In still another embodiment, the product is inserted through the opening 18 shown in FIG. 2C.

Figure 2D:
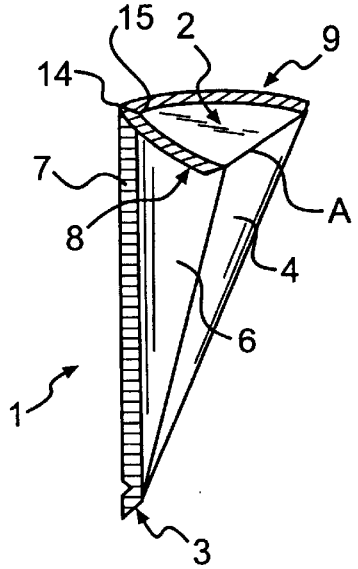

In a preferred embodiment, the second end 15 of the diagonal 12 is positioned so that there is no overlap between the end 15 and the end 14 on the final container 1 shown in FIG. 2D. This configuration avoids the presence of zones with more than two thicknesses. Sealing is preferably facilitated by welding along the seams 8 and 9 over the full width of the container 1, which allows an overlap of the weld zones and thus, at the intersection of the seams 7, 8 and 9, the container is leaktight.

Surprisingly, an examination of a preferred, finished container made according to a preferred method of the invention reveals that there is no "channel" between the inside of the container and the outside at the point where the three seams meet. In fact, the sealed seams can be positioned in pairs in one and the same plane and intersect substantially at right angles, in a manner similar to the welds of a flat, folded-sheet container.

A container of this type may be produced entirely automatically, at very low cost. The containers may then be grouped together in batches and packaged in auxiliary packaging, particularly in cardboard. They may then be marketed individually.

It will be apparent to those skilled in the art that various modifications and variations can be made to the structure and methodology of the present invention without departing from the scope or spirit of the claimed invention.

In the foregoing, it is intended that the present invention cover modifications and variations of this invention, provided they fall within the scope of the following claims and their equivalents.

What is claimed is:

1. A method of manufacturing a container, the method comprising:

providing a substantially square sheet of material, the sheet having first and second pairs of adjacent sides;

folding the sheet about a diagonal of the sheet;

joining at least portions of the first pair of sides together to form at least a portion of a first seam of the container, a first end of the diagonal being adjacent to the first seam;

folding the sheet about an axis substantially perpendicular to the diagonal to position a second end of the diagonal adjacent to an end of the first seam opposite to the first end of the diagonal;

joining portions of one of the second sides together to form a second seam of the container; and joining portions of the other of the second sides together to form a third seam of the container.

2. The method of claim 1, wherein the container includes a base and an apex, the base being defined by the second and third seams, the apex being substantially opposite to the base and adjacent to the first end of the diagonal.

3. A method of manufacturing a packaged product, the method comprising:

the method of manufacturing a container of claim 1; and inserting product into the container via an opening defined by the second pair of sides after folding the sheet about the diagonal.

4. A method of manufacturing a packaged product, the method comprising:

the method of manufacturing a container of claim 1; and inserting product into the container via an opening defined by the first pair of sides.

5. The method of claim 1, wherein the container includes a base and an apex, the apex being substantially opposite to the base and adjacent to the first end of the diagonal, and wherein the second and third seams extend in a plane including the base when the container is supported by the base.

6. The method of claim 1, wherein the first and second seams define a second face and the first and third seams define a third face, and wherein the first and second seams extend in a plane including the second face when the container is supported by the second face, and the first and third seams extend in a plane including the third face when the container is supported by the third face.

7. The method of claim 1, further comprising folding the sheet to facilitate the folding of the sheet about the axis substantially perpendicular to the diagonal.

8. The method of claim 1, wherein the folding of the sheet about the diagonal forms an intermediate structure including first and second walls, and wherein the method further comprises separating the first and second walls to form an opening defined between the first and second walls.

9. A method of manufacturing a packaged product, the method comprising:

the method of manufacturing a container of claim 8; and introducing product into the container via the opening.

10. A method of manufacturing a packaged product, the method comprising:

the method of manufacturing a container of claim 1; and introducing product into the container after at least substantial formation of one of the second and third seams and prior to substantial formation of the other of the second and third seams.

11. The method of claim 1, wherein each of said joinings includes sealing portions of the sheet.

12. The method of claim 11, wherein the sealing includes at least one of adhesive bonding and welding.

13. The method of claim 12, wherein the sealing includes the use of at least one of heat and ultrasound.

14. The method of claim 1, wherein the folding of the sheet about the axis substantially perpendicular to the diagonal includes moving portions of said one of the second sides toward one another and moving portions of said other of the second sides toward one another.

* * * * *